US008688021B2

(12) United States Patent
Kunii et al.

(10) Patent No.: US 8,688,021 B2
(45) Date of Patent: Apr. 1, 2014

(54) GLOSSING DEVICE, FIXING DEVICE, AND IMAGE FORMING APPARATUS INCORPORATING SAME

(75) Inventors: Hiroyuki Kunii, Kanagawa (JP); Akiyasu Amita, Kanagawa (JP); Satoshi Muramatsu, Kanagawa (JP); Kunihiko Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/471,878

(22) Filed: May 15, 2012

(65) Prior Publication Data

US 2012/0328344 A1 Dec. 27, 2012

(30) Foreign Application Priority Data

Jun. 21, 2011 (JP) ..... 2011-137464

(51) Int. Cl.
*G03G 15/20* (2006.01)

(52) U.S. Cl.
USPC ..... 399/329

(58) Field of Classification Search
USPC ..... 399/328, 329, 341
See application file for complete search history.

(56) References Cited

U.S. PATENT DOCUMENTS

| | | | |
|---|---|---|---|
| 5,527,657 | A | 6/1996 | Takeda et al. |
| 5,638,159 | A | 6/1997 | Kai et al. |
| 5,797,074 | A | 8/1998 | Kasahara et al. |
| 5,815,784 | A | 9/1998 | Kasahara et al. |
| 5,953,567 | A | 9/1999 | Muramatsu et al. |
| 5,960,246 | A | 9/1999 | Kasahara et al. |
| 5,987,298 | A | 11/1999 | Muramatsu et al. |
| 6,112,046 | A | 8/2000 | Suzuki et al. |
| 6,201,941 | B1 | 3/2001 | Kasahara et al. |
| 6,370,350 | B2 | 4/2002 | Tomita |
| 6,370,352 | B1 | 4/2002 | Tomita |
| 6,393,241 | B1 | 5/2002 | Matsumoto et al. |
| 6,413,690 | B2 | 7/2002 | Tomita |
| 6,455,217 | B2 | 9/2002 | Tomita |
| 6,492,084 | B2 | 12/2002 | Tomita |
| 6,505,016 | B2 | 1/2003 | Tomita |
| 6,507,720 | B2 | 1/2003 | Kabumoto et al. |
| 6,519,439 | B2 | 2/2003 | Tomita |
| 6,526,246 | B2 | 2/2003 | Iwata et al. |
| 6,542,707 | B2 | 4/2003 | Muramatsu et al. |

(Continued)

FOREIGN PATENT DOCUMENTS

| | | | |
|---|---|---|---|
| JP | 2003-270987 | A | 9/2003 |
| JP | 2004325934 | A | 11/2004 |

*Primary Examiner* — Walter L Lindsay, Jr.
*Assistant Examiner* — Barnabas Fekete
(74) *Attorney, Agent, or Firm* — Harness, Dickey & Pierce, P.L.C.

(57) ABSTRACT

A glossing device includes a first roller, a second roller, an endless rotary belt, a third roller, a heater, a belt cooler, and a suction mechanism. The second roller is disposed parallel to the first roller. The endless rotary belt is looped for rotation around the first and second rollers. The third roller is disposed opposite the first roller via the belt. The heater is disposed adjacent to the belt to heat the belt. The first and third rollers press against each other via the belt to form a nip therebetween. The belt cooler is disposed inside the loop of the belt downstream from the first roller and upstream from the second roller for cooling the belt. The belt cooler includes at least two mutually spaced cooling elements that together form a gapped contact surface for establishing thermal contact with the belt.

15 Claims, 4 Drawing Sheets

(56) References Cited

U.S. PATENT DOCUMENTS 6,567,637 B2 5/2003 Yanagisawa et al.
6,571,076 B2 5/2003 Kasahara et al.
6,597,883 B2 7/2003 Muramatsu et al.
6,608,983 B2 8/2003 Terazawa et al.
6,623,897 B2 9/2003 Tomita
6,628,908 B2 9/2003 Matsumoto et al.
6,628,913 B2 9/2003 Matsumoto et al.
6,653,039 B2 11/2003 Tomita
6,678,492 B1 1/2004 Terazawa et al.
6,748,190 B2 6/2004 Yanagisawa et al.
6,778,788 B2 8/2004 Tomita et al.
6,785,496 B2 8/2004 Iwata et al.
6,957,036 B2 10/2005 Kikuchi et al.
7,010,257 B2 3/2006 Someya et al.
7,039,346 B2 5/2006 Terazawa et al.
7,043,179 B2 5/2006 Matsumoto et al.
7,054,570 B2 5/2006 Kishi et al.
7,065,313 B2 6/2006 Matsumoto et al.
7,085,522 B2 8/2006 Muramatsu et al.
7,088,945 B2 8/2006 Matsumoto et al.
7,103,305 B2 9/2006 Koike et al.
7,116,923 B2 10/2006 Kishi et al.
7,116,928 B2 10/2006 Muramatsu et al.
7,127,198 B2 10/2006 Muramatsu et al.
7,127,202 B2 10/2006 Fujita et al.
7,130,555 B2 10/2006 Kishi et al.
7,130,558 B2 10/2006 Matsumoto et al.
7,139,520 B2 11/2006 Echigo et al.
7,177,580 B2 2/2007 Nakafuji et al.
7,209,675 B2 4/2007 Matsusaka et al.
7,209,689 B2 4/2007 Matsumoto et al.
7,212,758 B2 5/2007 Kishi et a
7,212,759 B2 5/2007 Kishi et a
7,218,880 B2 5/2007 Yanagisawa et al.
7,233,762 B2 6/2007 Kunii et al.
7,239,821 B2 7/2007 Matsusaka et al.
7,245,853 B2 7/2007 Muramatsu et al.
7,254,360 B2 8/2007 Tomita
7,254,362 B2 8/2007 Kikuchi et al.
7,257,348 B2 8/2007 Matsumoto et al.
7,269,384 B2 9/2007 Someya et al.
7,277,665 B2 10/2007 Terazawa et al.
7,289,748 B2 10/2007 Yanagisawa et al.
7,295,795 B2 11/2007 Suzuki et al.
7,299,003 B2 11/2007 Kurotaka et al.
7,308,216 B2 12/2007 Kishi et al.
7,309,553 B2 12/2007 Tomita et al.
7,313,336 B2 12/2007 Kadota et al.
7,333,743 B2 2/2008 Kishi et al.
7,333,760 B2 2/2008 Baba et al.
7,343,113 B2 3/2008 Matsusaka et al.
7,346,286 B2 3/2008 Matsumoto et al.
7,356,270 B2 4/2008 Matsusaka et al.
7,356,288 B2 4/2008 Iwata et al.
7,356,290 B2 4/2008 Matsumoto et al.
7,356,298 B2 4/2008 Tomita et al.
7,359,666 B2 4/2008 Takashi et al.
7,366,432 B2 4/2008 Kishi et al.
7,369,803 B2 5/2008 Echigo et al.
7,373,094 B2 5/2008 Kishi et al.
7,406,278 B2 7/2008 Katsuyama et al.
7,433,641 B2 10/2008 Kikuchi et al.
7,444,107 B2 10/2008 Takeuchi et al.
7,450,891 B2 11/2008 Muramatsu et al.
7,480,473 B2 1/2009 Matsuura et al.
7,496,309 B2 2/2009 Matsusaka et al.
7,509,079 B2 3/2009 Muramatsu et al.
7,512,364 B2 3/2009 Muramatsu et al.
7,515,845 B2 4/2009 Kishi et al.
7,526,242 B2 4/2009 Takagaki et al.
7,536,139 B2 5/2009 Katsuyama et al.
7,542,697 B2 6/2009 Matsumoto et al.
7,551,869 B2 6/2009 Kishi et al.
7,565,087 B2 7/2009 Matsusaka et al.
7,570,911 B2 8/2009 Nakafuji et al.
7,583,922 B2 9/2009 Takashi et al.
7,590,376 B2 9/2009 Tomita et al.
7,593,674 B2 9/2009 Matsumoto et al.
7,603,049 B2 10/2009 Kishi et al.
7,603,054 B2 10/2009 Katsuyama et al.
7,609,988 B2 10/2009 Kishi et al.
7,664,410 B2 2/2010 Takagi
7,738,827 B2 6/2010 Someya et al.
7,778,577 B2 8/2010 Muramatsu et al.
7,796,914 B2 9/2010 Matsumoto et al.
7,809,322 B2 10/2010 Takeuchi et al.
7,885,569 B2 2/2011 Kishi et al.
7,894,753 B2 2/2011 Kasahara et al.
7,904,006 B2 3/2011 Muramatsu
7,912,392 B2 3/2011 Yoshinaga et al.
7,917,055 B2 3/2011 Katsuyama et al.
7,925,177 B2 4/2011 Ishii et al.
7,957,663 B2 6/2011 Kishi et al.
8,073,352 B2 12/2011 Kunii et al.
8,131,198 B2 3/2012 Ishii et al.
2001/0006583 A1 7/2001 Tomita
2001/0052526 A1 12/2001 Kasahara et al.
2002/0006566 A1 1/2002 Tomita
2002/0009310 A1 1/2002 Kabumoto et al.
2002/0009315 A1 1/2002 Tomita
2002/0025195 A1 2/2002 Iwata et al.
2002/0025196 A1 2/2002 Matsumoto et al.
2002/0031363 A1 3/2002 Tomita et al.
2002/0039502 A1 4/2002 Matsumoto et al.
2002/0106221 A1 8/2002 Muramatsu et al.
2002/0164178 A1 11/2002 Muramatsu et al.
2003/0012586 A1 1/2003 Iwata et al.
2003/0031947 A1 2/2003 Tomita
2003/0039911 A1 2/2003 Tomita et al.
2003/0198487 A1 10/2003 Yanagisawa et al.
2003/0207194 A1 11/2003 Tomita
2004/0091287 A1 5/2004 Matsumoto et al.
2004/0197119 A1 10/2004 Matsumoto et al.
2004/0245241 A1 12/2004 Kishi et al.
2004/0247332 A1 12/2004 Kishi et al.
2004/0247334 A1 12/2004 Kishi et al.
2004/0258426 A1 12/2004 Kishi et al.
2005/0025527 A1 2/2005 Matsumoto et al.
2005/0025534 A1 2/2005 Fujita et al.
2005/0025537 A1 2/2005 Echigo et al.
2005/0089347 A1 4/2005 Muramatsu et al.
2005/0095037 A1 5/2005 Koike et al.
2005/0117943 A1 6/2005 Nakafuji et al.
2005/0139584 A1 6/2005 Kishi et al.
2005/0152721 A1 7/2005 Kikuchi et al.
2005/0158075 A1 7/2005 Echigo et al.
2005/0158083 A1 7/2005 Muramatsu et al.
2005/0163537 A1 7/2005 Muramatsu et al.
2005/0169673 A1 8/2005 Matsumoto et al.
2005/0175368 A1 8/2005 Matsusaka et al.
2005/0175370 A1 8/2005 Matsusaka et al.
2005/0180782 A1 8/2005 Matsumoto et al.
2005/0191078 A1 9/2005 Kishi et al.
2005/0201783 A1 9/2005 Kurotaka et al.
2005/0207801 A1 9/2005 Kunii et al.
2005/0232664 A1 10/2005 Tomita
2005/0265759 A1 12/2005 Takeuchi et al.
2005/0281592 A1 12/2005 Muramatsu et al.
2005/0286920 A1 12/2005 Baba et al.
2006/0008281 A1 1/2006 Matsumoto et al.
2006/0008302 A1 1/2006 Someya et al.
2006/0013604 A1 1/2006 Kadota et al.
2006/0013624 A1 1/2006 Kurotaka et al.
2006/0019082 A1 1/2006 Kikuchi et al.
2006/0024095 A1 2/2006 Suzuki et al.
2006/0029411 A1 2/2006 Ishii et al.
2006/0039713 A1 2/2006 Kishi et al.
2006/0045571 A1 3/2006 Matsuura et al.
2006/0051111 A1 3/2006 Kishi et al.
2006/0051112 A1 3/2006 Matsusaka et al.
2006/0051113 A1 3/2006 Kishi et al.
2006/0051119 A1 3/2006 Kishi et al.
2006/0051120 A1 3/2006 Kishi et al.
2006/0051121 A1 3/2006 Matsusaka et al.

(56) References Cited

U.S. PATENT DOCUMENTS

| | | | |
|---|---|---|---|
| 2006/0088349 | A1 | 4/2006 | Someya et al. |
| 2006/0099006 | A1 | 5/2006 | Yanagisawa et al. |
| 2006/0120776 | A1 | 6/2006 | Takashi et al. |
| 2006/0127118 | A1 | 6/2006 | Kishi et al. |
| 2006/0140679 | A1 | 6/2006 | Iwata et al. |
| 2006/0140689 | A1 | 6/2006 | Echigo et al. |
| 2006/0159477 | A1 | 7/2006 | Tomita et al. |
| 2006/0171749 | A1 | 8/2006 | Tomita et al. |
| 2006/0182460 | A1 | 8/2006 | Kishi et al. |
| 2007/0009289 | A1 | 1/2007 | Muramatsu et al. |
| 2007/0014600 | A1 | 1/2007 | Ishii et al. |
| 2007/0031159 | A1 | 2/2007 | Kishi et al. |
| 2007/0065188 | A1 | 3/2007 | Takagaki et al. |
| 2007/0092303 | A1 | 4/2007 | Katsuyama et al. |
| 2007/0104520 | A1 | 5/2007 | Nakafuji et al. |
| 2007/0110480 | A1 | 5/2007 | Matsumoto et al. |
| 2007/0122207 | A1 | 5/2007 | Matsumoto et al. |
| 2007/0189813 | A1 | 8/2007 | Matsumoto et al. |
| 2007/0212090 | A1 | 9/2007 | Matsusaka et al. |
| 2008/0038019 | A1 | 2/2008 | Kasahara et al. |
| 2008/0069596 | A1 | 3/2008 | Katsuyama et al. |
| 2008/0145088 | A1 | 6/2008 | Matsusaka et al. |
| 2008/0152380 | A1 | 6/2008 | Matsumoto et al. |
| 2008/0219683 | A1 | 9/2008 | Muramatsu |
| 2008/0219716 | A1 | 9/2008 | Takashi et al. |
| 2008/0253789 | A1 | 10/2008 | Yoshinaga et al. |
| 2009/0041520 | A1 | 2/2009 | Takeuchi et al. |
| 2009/0080945 | A1 | 3/2009 | Muramatsu et al. |
| 2009/0123172 | A1 | 5/2009 | Kishi et al. |
| 2009/0129811 | A1 | 5/2009 | Katsuyama et al. |
| 2009/0154967 | A1 | 6/2009 | Tomita |
| 2009/0169232 | A1 | 7/2009 | Kunii et al. |
| 2009/0185832 | A1 | 7/2009 | Muramatsu et al. |
| 2009/0317113 | A1 | 12/2009 | Kishi et al. |
| 2009/0324298 | A1 | 12/2009 | Katsuyama et al. |
| 2010/0008706 | A1 | 1/2010 | Sugiura et al. |
| 2010/0232818 | A1 | 9/2010 | Kunii |
| 2010/0239337 | A1 | 9/2010 | Muramatsu et al. |
| 2010/0310289 | A1 | 12/2010 | Someya et al. |
| 2011/0064493 | A1 | 3/2011 | Muramatsu et al. |
| 2011/0064494 | A1 | 3/2011 | Amita et al. |
| 2011/0085815 | A1 | 4/2011 | Kishi et al. |
| 2011/0176822 | A1 | 7/2011 | Ishii et al. |
| 2011/0188911 | A1* | 8/2011 | Kunii et al. ..... 399/342 |
| 2012/0008153 | A1 | 1/2012 | Kunii et al. |
| 2012/0201579 | A1 | 8/2012 | Kunii et al. |
| 2012/0224898 | A1 | 9/2012 | Amita et al. |

* cited by examiner

GLOSSING DEVICE, FIXING DEVICE, AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-137464, filed on Jun. 21, 2011, the entire disclosure of which is hereby incorporated by reference herein.

BACKGROUND OF THE INVENTION

1. Technical Field

The present invention relates to a glossing device, a fixing device, and an image forming apparatus incorporating the same, and more particularly, to a fixing device that processes a toner image with heat and pressure on a recording medium for imparting gloss, and an electrophotographic image forming apparatus, such as a photocopier, facsimile machine, printer, plotter, or multifunctional machine incorporating several of these features, which incorporates such a fixing device with a glossing capability.

2. Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process may be followed by a fixing process using a fixing device, which permanently fixes the toner image in place on the recording medium by melting and setting the toner with heat and pressure.

Modern image forming apparatuses accommodate a wide range of printing applications with different levels of image quality, using various types of recording media. In particular, printing of photographs and computer-generated images, which typically contain a wide, complete range of visible colors, necessitates a higher level of image quality and uniformity of image gloss than is required for conventional monochrome image formation.

Various techniques have been proposed to meet a growing demand for printers with high-gloss, high-quality imaging performance. Some such techniques employ a special, transparent toner, called "clear toner", for creating a transparent glossy effect on those areas of a recording medium where no color toner is deposited; others address duplex printing with a uniform, glossy finish on both sides of a recording medium. Among these, several techniques are directed to development of a more sophisticated fixing process.

Structurally, a fixing device with a glossing capability may be constructed of an endless rotary belt on which a recording medium is conveyed while subjected to heat and pressure. The endless belt is looped for rotation around multiple parallel rollers, including a heated roller and a separator roller, with a pressure roller disposed opposite the heated roller via the belt to form a fixing nip therebetween. During operation, a recording medium is conveyed through the fixing nip to process a toner image under heat and pressure. After passage through the fixing nip, the recording medium closely contacts the belt as the belt moves from the heated roller toward the separator roller, and separates from the belt as the belt passes around the separator roller.

For example, a belt-based fixing system has been proposed which includes a thermal pre-fixing unit and a gloss adjustment unit. The pre-fixing unit consists of a pair of opposed heated rollers pressing against each other to form a pre-fixing nip therebetween. The gloss adjustment unit consists of a smooth, endless rotary belt entrained around a pair of motor-driven and idler rollers, with a pressure roller opposite the motor-driven roller to form a main fixing nip therebetween.

In this fixing system, a recording medium is initially passed through the pre-fixing unit, which renders an unfixed powder toner image into a semi-fluid, soft pliable state. After pre-fixing, the recording medium is conveyed to the gloss adjustment unit with the toner image pressed against the endless belt, which imparts gloss to the toner image as the molten toner gradually cools and solidifies while conforming to the smooth surface of the belt. The gloss adjustment unit adjusts glossiness of the toner image by adjusting a distance or duration during which the toner image travels on the belt downstream from the fixing nip.

To date, belt-based fixing devices are designed with a belt cooler for cooling an endless rotary belt during conveyance of a recording medium downstream from a fixing nip, so as to provide uniform cooling and proper separation of the recording medium from the belt after fixing and glossing a toner image thereon.

For example, one known fixing device includes an endless fixing belt entrained around multiple rollers, including a pair of first and second motor-driven rollers, as well as a belt cooler disposed between the first and second rollers inside the loop of the fixing belt.

For maintaining close contact between the fixing belt and the belt cooler, this fixing device is provided with a belt tightening capability, in which the first motor-driven roller is driven at a rotational speed slower than that of the second motor-driven roller, so as to tighten the belt between the first motor-driven roller and the cooler downstream in a longitudinal direction in which the belt rotates around the multiple rollers. Keeping the fixing belt in proper tension prevents the belt from deformation due to being held on the supporting rollers for extended periods of time, as well as sags and creases resulting from thermal expansion/contraction of the belt material subjected to repeated heating and cooling cycles, which would otherwise affect uniformity of gloss across a resulting image.

Although generally successful for its intended purpose, the belt-based fixing device depicted above has several drawbacks. That is, tightening the belt in the longitudinal direction to establish close contact between the belt and the cooler increases the torque required to drive the belt. Also, such arrangement necessitates an extremely high level of precision during assembly of the fixing device. Further, increased longitudinal tension in the belt can lead to accelerated wear and tear of the adjoining surfaces of the belt and the belt cooler, which slide against each other during rotation of the belt.

SUMMARY OF THE INVENTION

Exemplary aspects of the present invention are put forward in view of the above-described circumstances, and provide a novel glossing device for processing a toner image on a recording medium.

In one exemplary embodiment, the glossing device includes a first roller, a second roller, an endless rotary belt, a third roller, a heater, a belt cooler, and a suction mechanism. The second roller is disposed parallel to the first roller. The endless rotary belt is looped for rotation around the first and second rollers in a longitudinal, conveyance direction of the belt. The third roller is disposed opposite the first roller via the belt. The heater is disposed adjacent to the belt to heat the belt.

The first and third rollers press against each other via the belt to form a nip therebetween through which the recording medium is conveyed to process a toner image under heat and pressure. The recording medium after passage through the nip remains in contact with the belt as the belt moves from the first roller toward the second roller, and separates from the belt as the belt passes around the second roller. The belt cooler is disposed inside the loop of the belt downstream from the first roller and upstream from the second roller for cooling the belt. The belt cooler includes at least two mutually spaced cooling elements that together form a gapped contact surface for establishing thermal contact with the belt with a gap between the mutually spaced cooling elements. The suction mechanism is connected to the belt cooler to create suction within the gap to attract the belt to the gapped contact surface of the belt cooler.

Other exemplary aspects of the present invention are put forward in view of the above-described circumstances, and provide a fixing device incorporating a glossing device.

Still other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
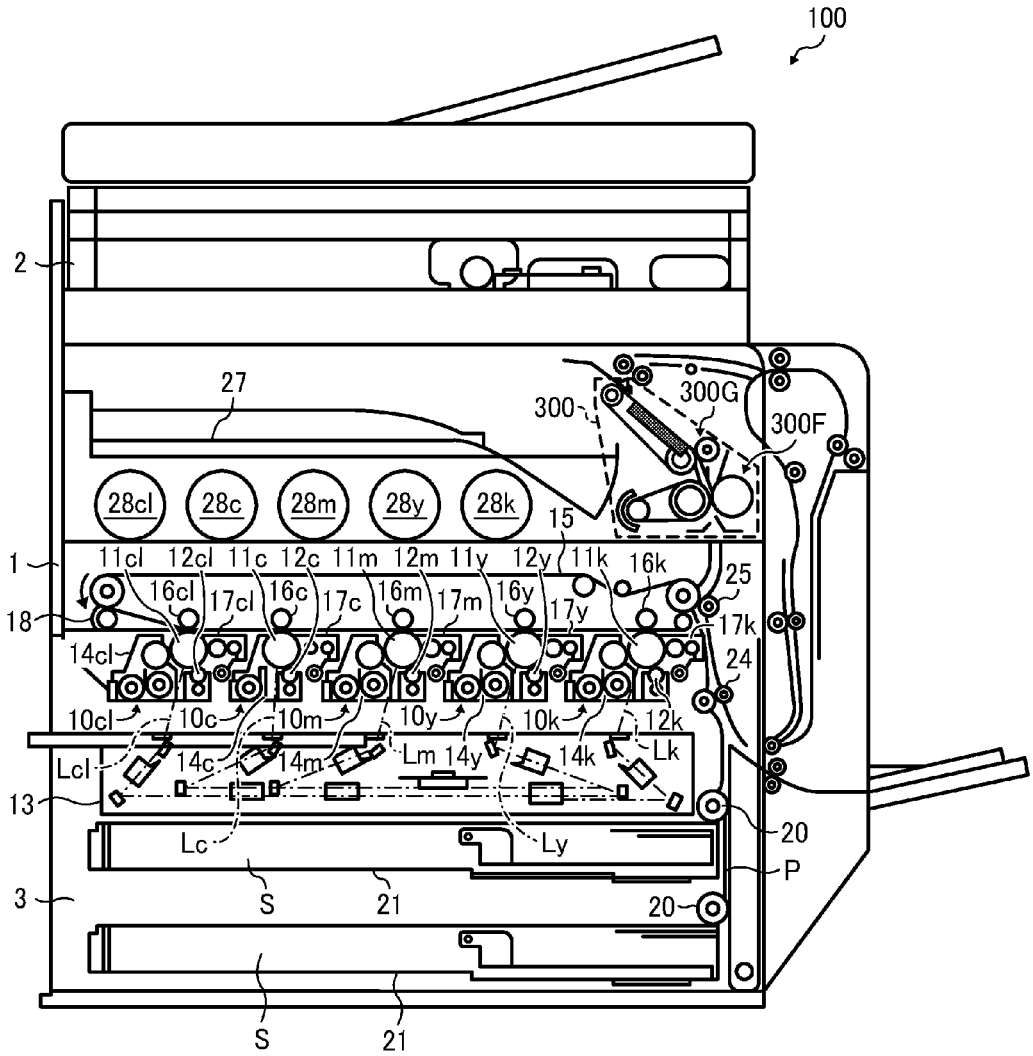
FIG. 1 schematically illustrates an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 incorporating a fixing device 300 according to one or more embodiments of this patent specification.

As shown in FIG. 1, the image forming apparatus 100 in the present embodiment includes a printing unit 1 located at a central part of the apparatus body for printing a toner image on a recording medium such as a sheet S of paper, above which may be deployed an image scanning unit 2 for capturing image information from a user-supplied original document.

In the image forming apparatus 100, the printing unit 1 comprises a tandem color printer including five imaging stations 10*cl*, 10*c*, 10*m*, 10*y*, 10*k* arranged in series generally horizontally below an intermediate transfer belt 15 and above an exposure unit 13, which together form an electrophotographic mechanism to form an image with toner particles on a recording sheet S for subsequent processing through the fixing device 300 located adjacent to the intermediate transfer belt 15.

The imaging stations (indicated collectively by the reference numeral 10) are of a substantially identical configuration, each having a drum-shaped photoconductor 11 surrounded by a charging device 12 for charging the photoconductor surface to generate a latent image, a development device 14 for developing the latent image into a visible form using toner, and a cleaning device 17 for cleaning the photoconductive surface of residual toner, which work in cooperation to form a toner image of a particular color, as designated by the suffixes "c" for cyan, "m" for magenta, "y" for yellow, "k" for black, and "cl" for a clear or transparent color. The imaging stations 10*cl*, 10*c*, 10*m*, 10*y*, 10*k* are supplied with toner from toner bottles 28*cl*, 28*c*, 28*m*, 28*y*, and 28*k*, respectively, each of which is connected with the development device 14 through a suitable piping or conduit for transporting toner.

The intermediate transfer belt 15 is entrained around multiple belt support rollers and primary transfer rollers 16*cl*, 16*c*, 16*m*, 16*y*, and 16*k* for rotation counterclockwise in the drawing, passing through five primary transfer nips defined between the primary transfer rollers 16 and the corresponding photoconductive drums 11, and then through a secondary transfer nip defined between a belt support roller and the secondary transfer roller 25, followed by meeting a belt cleaner 18 downstream from the secondary transfer nip.

The fixing device 300 includes a fixing unit 300F for fixing a toner image in place on a recording sheet S, and a glossing unit 300G for imparting gloss to the toner image after fixing. Each of the fixing and glossing units 300F and 300G includes a pair of opposed rotary members, at least one of which is heated, and at least one of which is pressed against the other one, to form a heated area of contact called a nip, through which the toner image is processed with heat and pressure on the recording sheet S. Specific configurations of the fixing device 300 will be described later in more detail with reference to FIG. 2 and subsequent drawings.

Below the printing unit 1 is a media conveyance unit 3 for supplying recording sheets S to the printing unit 1. The media conveyance unit 3 includes one or more input sheet trays 21 each accommodating a stack of recording sheets S for feeding with a feed roller 20, as well as various conveyor and guide members, such as a pair of registration rollers 24, together defining a sheet conveyance path P along which a recording sheet S advances upward from the input tray 21 to pass through the secondary transfer nip and then through the fixing device 300 to finally reach an in-body output sheet tray 27.

During operation, the printing unit 1 activates the imaging stations 10 to form a toner image on an outer surface of the intermediate transfer belt 15 according to image data supplied from a data source, such as from the image scanning unit 2 in case of photocopying, from a host computer in case of printing, or from a remote location via a phone line in case of facsimile.

Specifically, upon activation, each imaging station 10 rotates the photoconductor drum 11 counterclockwise in the drawing to forward its outer, photoconductive surface to a series of electrophotographic processes, including charging, exposure, development, transfer, and cleaning, in one rotation of the photoconductor drum 11.

First, the photoconductive surface is uniformly charged to a particular polarity by the charging device 12 and subsequently exposed to a modulated laser beam L emitted from the exposure unit 13 to which electronic signals are supplied from a data source. The laser exposure selectively dissipates the charge on the photoconductive surface to form an electrostatic latent image thereon according to image data representing a particular primary color. Then, the latent image enters the development device 14 which renders the incoming image visible using toner. The toner image thus obtained is forwarded to the primary transfer nip between the intermediate transfer belt 15 and the primary transfer roller 16.

At the primary transfer nip, the primary transfer roller 16 is supplied with a bias voltage of a polarity opposite that of the toner on the photoconductor drum 11. This electrostatically transfers the toner image from the photoconductive surface to an outer surface of the belt 15, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 15.

After primary transfer, the photoconductor 11 enters the cleaning device 17 to remove residual toner from the photoconductive surface for preparation for a subsequent imaging cycle. At the same time, the intermediate transfer belt 15 forwards the multicolor image to the secondary transfer nip between the belt support roller and the secondary transfer roller 25.

Meanwhile, in the media conveyance unit 3, the conveyor rollers introduce a recording sheet S from the input sheet tray 21 toward the pair of registration rollers 24 being rotated. Upon receiving the fed sheet S, the registration rollers 24 stop rotation to hold the incoming sheet S therebetween, and then advance it in sync with the movement of the intermediate transfer belt 15 to the secondary transfer nip. At the secondary transfer nip, the multicolor image is transferred from the belt 15 to the recording sheet S.

After secondary transfer, the intermediate transfer belt 15 advances to the belt cleaner 18, which removes residual toner from the belt surface to prepare it for a subsequent imaging cycle. At the same time, the recording sheet S bearing the powder toner image thereon is introduced into the fixing device 300, at which the fixing unit 300F fixes the multicolor image in place on the recording sheet S with heat and pressure, followed by the glossing unit 300G processing the fixed toner image with heat and pressure to impart gloss to the resulting print. Thereafter, the recording sheet S is ejected to the output tray 27 for stacking inside the apparatus body, which completes one operational cycle of the image forming apparatus 100.

Although the embodiment above is directed to an operation in which printing is performed using all the five imaging stations 10 to form a full-color image with a glossy, textured surface, the image forming apparatus 100 may selectively operate in multiple modes of operation, such as a monochrome mode and a multi- or full-color mode, with a specific combination of imaging stations 10*cl*, 10*c*, 10*m*, 10*y*, 10*k* activated to create an image in a particular color or tone as desired.

Also, the image forming apparatus 100 may selectively operate in a glossing mode in which a toner image is finished with an enhanced gloss, or in a normal fixing mode in which a toner image is processed without gloss finishing, as specified by a user, or depending on the type of recording medium S used in a given print job. In such cases, the glossing unit 300G is configured to change relative positions of the rotary members forming a nip therebetween, which is selectively established during operation in the normal fixing mode and de-established during operation in the glossing mode.

Figure 2:
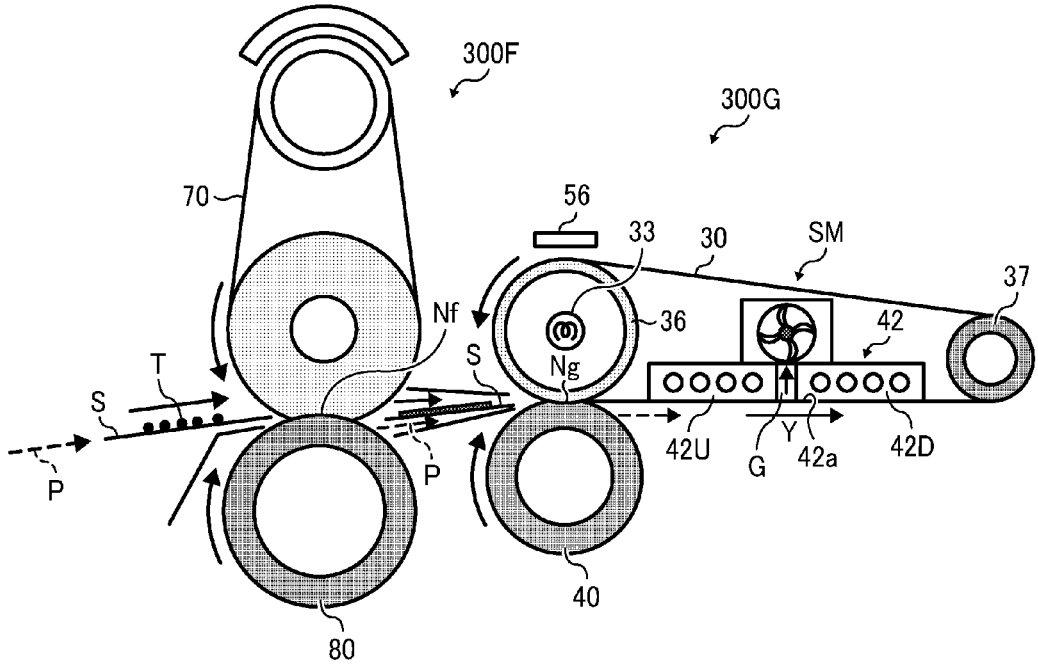
FIG. 2 is an end-on, axial view of the fixing device incorporating a glossing unit with a suction mechanism according to one or more embodiments of this patent specification.

FIG. 2 is an end-on, axial view of the fixing device 300 according to one or more embodiments of this patent specification.

As shown in FIG. 2, the fixing device 300 includes a fixing unit 300F to fix a toner image T in place on a recording sheet S conveyed along a sheet conveyance path P, and a glossing unit 300G disposed downstream from the fixing unit 300F along the sheet conveyance path P to process the toner image T with heat and pressure, so as to impart gloss to the resulting print on the recording sheet S.

The fixing unit 300F includes a pair of rotary fixing members 70 and 80, at least one of which is heated, and at least one of which is pressed against the other one to form a fixing nip Nf therebetween. In the present embodiment, for example, the fixing unit 300F includes a heated, endless fuser belt 70 paired with a pressure roller 80 pressed against the fuser belt 70. Any suitable type of heating mechanism may be employed to heat the fuser belt 70, such as, for example, a radiant, halogen lamp or an electromagnetic induction heater, depending on specific configurations of the fixing process.

The glossing unit 300G includes a first, heat roller 36; a second, stripper roller 37 disposed parallel to the first roller 36; an endless rotary belt 30 looped for rotation around the first and second rollers 36 and 37 in a longitudinal, conveyance direction Y of the glossing belt 30; a third, pressure roller 40 disposed opposite the first roller 36 via the glossing belt 30; a heater 33 disposed in the first roller 36 to heat the glossing belt 30; and a belt cooler 42 disposed inside the loop of the glossing belt 30 downstream from the first roller 36 and upstream from the second roller 37 for cooling the glossing belt 30.

The first and third rollers 36 and 40 press against each other via the glossing belt 30 to form a glossing nip Ng therebetween through which a recording medium S is conveyed to process a toner image T under heat and pressure. The recording medium S after passage through the glossing nip Ng remains in contact with the glossing belt 30 as the belt 40 moves from the first roller 36 toward the second roller 37, and separates from the glossing belt 30 as the glossing belt 30 passes around the second roller 37.

As used herein, the terms "upstream" and "downstream" are used to describe relative positions of components surrounding the glossing belt 30 in the longitudinal, conveyance direction Y in which the glossing belt 30 moves from the first roller 36 toward the second roller 37 during operation of the fixing device 300, in particular, the position of the belt cooler 42 with respect to the first and second rollers 36 and 37 in the conveyance direction Y of the belt 30. Unless otherwise specified, these directional terms also apply to describe positioning of a surrounding structure of the belt cooler 42 in the conveyance direction Y of the glossing belt 30.

Optionally, the glossing unit 300G may be equipped with a non-contact temperature sensor or thermometer 56 adjacent to the heat roller 36 outside the loop of the glossing belt 30 and on the side of the heat roller 36 away from the pressure roller 40 to measure temperature at an outer surface of the glossing belt 30. A controller, such as a central processing unit (CPU) with associated memory devices, may be provided to optimize operation of the heater 33 according to readings of the thermometer 56 to maintain the belt temperature at a desired operational temperature.

During operation, after image formation through an electrophotographic imaging unit according to a print request in a manner as described above with reference to FIG. 1, a recording sheet S bearing an unfixed toner image T thereon enters the fixing unit 300F.

In the fixing unit 300F, the incoming sheet S passes through the fixing nip Nf, which melts and fuses toner with heat from the fuser belt 70 and pressure from the pressure roller 80, resulting in the toner image T fixed in place on the recording sheet S. After fixing, the recording sheet S enters the glossing unit 300G.

In the glossing unit 300G, the incoming sheet S initially passes through the glossing nip Ng along the rotating belt 30, which re-melts the once-fixed toner image T with heat from the heat roller 36 and pressure between the opposed rollers 36 and 40. The recording sheet S after passing through the glossing nip Ng is conveyed with its printed surface contacting the belt surface, as the glossing belt 30 moves from the heat roller 36 toward the stripper roller 37 in the longitudinal, conveyance direction Y of the glossing belt 30.

The inner, back side of the glossing belt 30 traveling from the first roller 36 toward the second roller 37 is cooled by the belt cooler 42 from inside the loop of the glossing belt 30, which in turn cools the printed surface of the recording sheet S on the outer, front side of the glossing belt 30. As the recording sheet S cools, the re-molten toner T contacting the belt surface also cools and solidifies to assume a smooth, uniform surface in conformity with the smooth outer surface of the glossing belt 30, resulting in a smooth, glossy effect created on the printed surface of the recording sheet S.

After cooling downstream from the glossing nip Ng, the recording sheet S on the rotating belt 30 then meets the stripper roller 37, at which the curvature of the stripper roller 37 causes the sheet S to separate from the belt surface and finally exit the glossing unit 300G.

In the present embodiment, the first, heat roller 36 comprises a cylindrical body of thermally conductive material, such as aluminum, stainless steel, iron, or the like, approximately 30 mm to approximately 90 mm in diameter. An optional, coating layer of elastic material, such as silicone rubber or the like, approximately 0.5 mm to approximately 5 mm thick, may be provided on an outer surface of the heat roller 36 to create an increased area of contact between the opposed rollers 36 and 40 at the glossing nip Ng.

The second, stripper roller 37 comprises a cylindrical body of suitable material, such as iron, aluminum, stainless steel, or the like, approximately 10 mm to approximately 30 mm in diameter.

The endless glossing belt 30 comprises a looped flexible belt of heat-resistant resin or metal, such as polyimide, nickel, stainless steel, or the like, approximately 10 μm to approximately 200 μm in thickness, and approximately 80 mm to approximately 300 mm in diameter in its generally cylindrical configuration. An optional, coating layer of elastic material, such as silicone rubber or the like, approximately 5 μm to approximately 50 μm thick may be provided on the outer surface of the glossing belt 30 for allowing close, uniform contact with the printed surface of the recording sheet S conveyed on the glossing belt 30. Also, the outermost surface of the glossing belt 30 may be provided with a coating of release agent, such as silicone or fluorine resin, for providing ready separation of the recording sheet S from the glossing belt 30.

The third, pressure roller 40 comprises a cylindrical body approximately 30 mm to approximately 90 mm in diameter, consisting of a cylindrical core of suitable material, such as iron, aluminum, stainless steel, or the like, covered with an outer layer of elastic material, such as fluorine rubber, silicone rubber, or the like, approximately 1 mm to approximately 50 mm thick, deposited on the cylindrical core.

The pressure roller 40 is equipped with a suitable biasing mechanism formed, for example, of a rotary actuator connected to the roller rotational axis through a cam, which allows the pressure roller 40 to move relative to the glossing belt 30 and the heat roller 36, so as to adjust width and strength of the glossing nip Ng determined by relative positions of the rotational axes of the opposed rollers 36 and 40. The pressure roller 40 also has a suitable rotary driver motor connected to the roller rotational axis, which rotationally drives the roller 40 to in turn rotate the heat roller 36 as well as the glossing belt 30 and the stripper roller 37.

The heater 33 comprises any suitable heat source that generates an amount of heat sufficient to re-melt and re-fuse toner accommodated in the fixing device 300. In the present embodiment, for example, the heater 33 is a halogen heater disposed inside the heat roller 36 to radiate heat to an inner surface of the heat roller 36, from which heat is imparted to the glossing belt 30 entrained around the heated roller 36. Operation of the heater 33 is computer-controlled according to readings of the thermometer 56 so as to maintain the belt surface at a desired operational temperature.

The belt cooler 42 includes at least two mutually spaced cooling elements that together form a gapped contact surface 42*a* for establishing thermal contact with the belt with a gap G between the mutually spaced cooling elements.

Specifically, in the present embodiment, the belt cooler 42 includes a pair of upstream and downstream, mutually spaced cooling elements 42U and 42D extending parallel to each other to define an elongated gap G therebetween extending at least in a transverse direction X (i.e., the direction in which figure is drawn) perpendicular to the conveyance direction Y of the belt 30. The elongated gap G may have a width of, for example, approximately 5 millimeters to approximately 20 millimeters in the conveyance direction Y of the belt 30.

Each of the cooling elements 42U and 42D comprises a separate, independent cooling jacket formed of metal with high thermal conductivity, such as aluminum, copper, stainless steel, or the like, which absorbs heat from a heated surface upon direct contact with the cooling jacket. The cooling jacket may be formed in any suitable configuration, such as a finned shape for air-cooling using a mechanical fan, or liquid or water-cooling using a heat pipe.

The gapped contact surface 42*a* of the belt cooler 42 comprises a convex surface with its curvature dimensioned to keep the recording sheet S in contact with the glossing belt 30 during conveyance along the belt cooler 42. The convex surface 42*a* may be configured to intrude into a common tangent plane between the first and second rollers 36 and 37 (i.e., an imaginary plane in which the belt would extend if entrained without the belt cooler between the first and second rollers). Such configuration of the contact surface 42*a* allows the belt cooler 42 to stably press against the glossing belt 30, resulting in close, continuous contact between the cooler and belt surfaces to promote efficient transfer of heat from the glossing belt 30 to the belt cooler 42.

With continued reference to FIG. 2, the glossing unit 300G is shown further including a suction mechanism SM connected to the belt cooler 42 to create suction within the gap G between the mutually spaced cooling elements 42U and 42D, so as to attract the belt 30 to the gapped contact surface 42*a* of the belt cooler 42. Such attraction toward the belt cooler 42 causes the belt 30 to tighten from its inner, back side during rotation downstream from the glossing nip Ng, which prevents the belt 30 from sagging or creasing, while retaining the belt 30 in close, continuous contact with the contact surface 42*a* of the belt cooler 42. Keeping the belt 30 in proper tension leads to uniform and efficient heat transfer from the belt 30 to the belt cooler 42 for concomitant equalization of temperature along the belt 30, which eventually allows for a high, uniform gloss across a resulting image processed through the glossing unit 300G.

Figure 3:
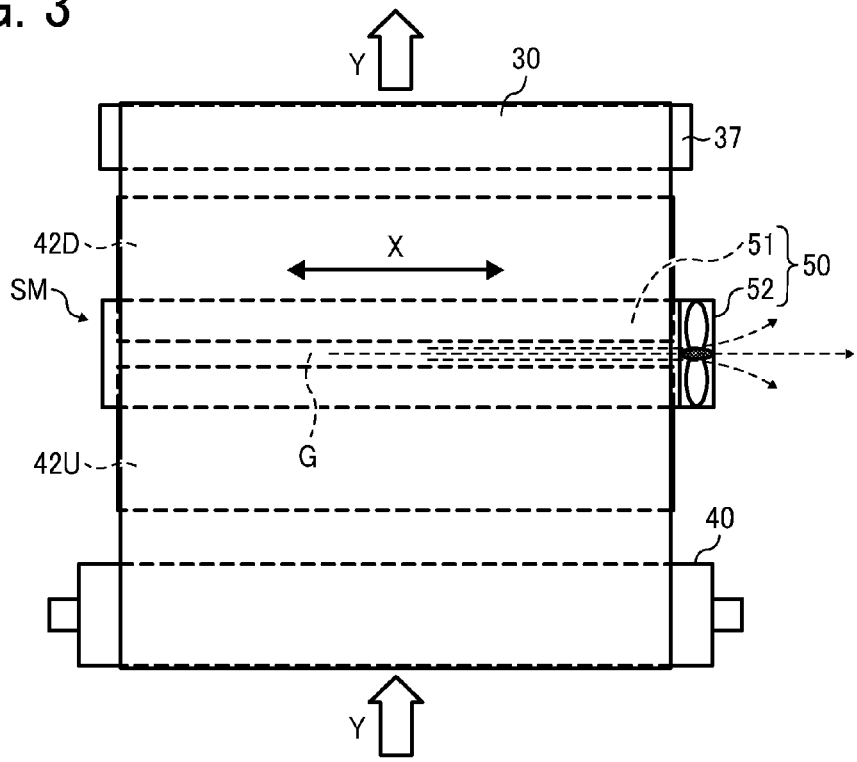
FIG. 3 is a top plan view of the glossing unit including the suction mechanism according to a first embodiment of this patent specification.

Referring now to FIG. 3 and subsequent drawings, a description is given below of various configurations of the suction mechanism SM according to one or more embodiments of this patent specification, wherein the suction mechanism SM includes one or more suction sources 50 each directed to a particular section of the gap G between the mutually spaced cooling elements 42U and 42D, each of which may be formed of a duct 51 extending generally parallel to and in fluid communication with the gap G between the mutually spaced cooling elements 42U and 42D, and a fan 52 connected to the duct 51 to exhaust air from the gap G through the duct 51 to generate a negative pressure within the gap G.

FIG. 3 is a top plan view of the glossing unit 300G including the suction mechanism SM according to a first embodiment of this patent specification.

As shown in FIG. 3, in the present embodiment, the suction mechanism SM comprises a single suction source 50 formed of an elongated duct 51 extending generally parallel to and in fluid communication with the gap G between the mutually spaced cooling elements 42U and 42D, and a fan 52 connected to the duct 51 to exhaust air from the gap G through the duct 51 to generate a negative pressure within the gap G.

Specifically, the duct 51 may be configured as a longitudinally slotted, perforated, or otherwise open tube or pipe, having a longitudinal opening and at least one open end, which is positioned on the belt cooler 42 with its longitudinal opening directed to the gap G between the cooling elements 42U and 42D, and its open end coupled with the fan 52. The fan 52 may be any suitable device that can create an air flow from inside to outside the gap G through the duct 51, whose operation can be controlled, for example, through a computer-controlled drive motor.

During operation, the suction mechanism SM is activated where necessary, for example, as the belt 30 starts rotation to process a recording sheet S forwarded form the fixing unit 300F. Upon activation, the fan 52 draws air from the gap G through the duct 51, which eventually lowers the pressure within the gap G, resulting in a suction force that sucks up the belt 30 toward the gap G defined in the contact surface 42*a* of the belt cooler 42.

Figure 4:
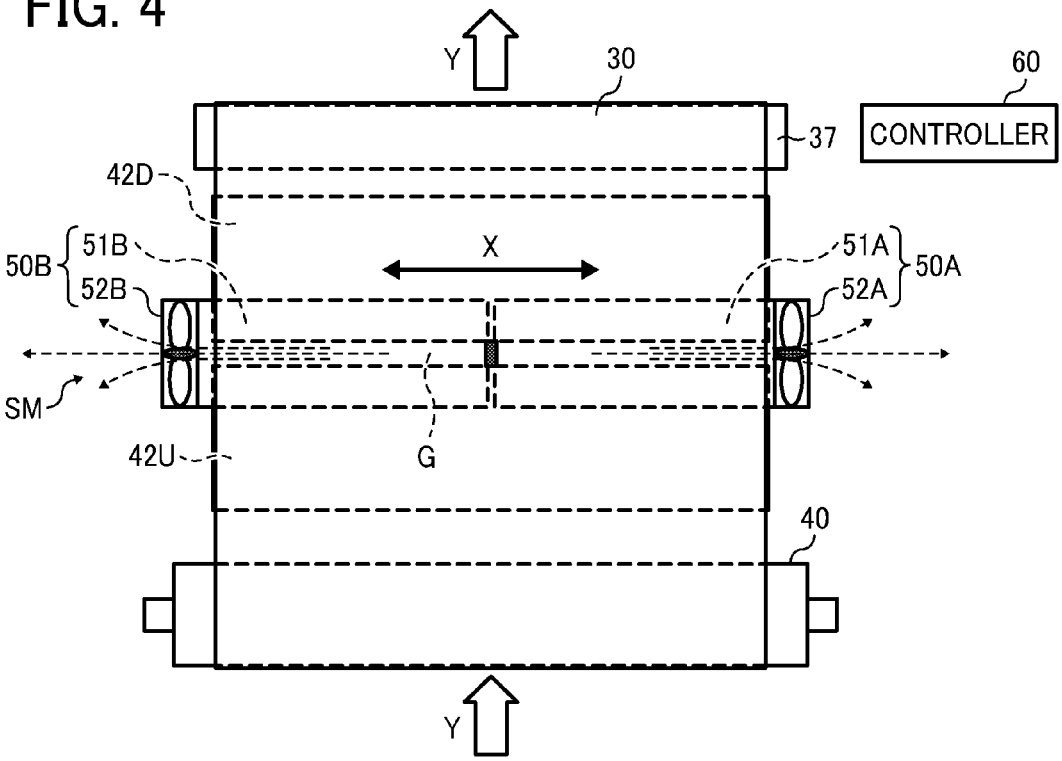
FIG. 4 is a top plan view of the glossing unit including the suction mechanism according to a second embodiment of this patent specification.

FIG. 4 is a top plan view of the glossing unit 300G including the suction mechanism SM according to a second embodiment of this patent specification.

As shown in FIG. 4, the overall configuration of the present embodiment is similar to that depicted primarily with reference to FIG. 3, except that the suction mechanism SM includes, instead of a single suction source, a pair of first and second suction sources 50A and 50B directed to two opposite side sections of the gap G opposite to each other in the transverse direction X of the belt 30, as well as a controller 60 operatively connected with the suction sources 50A and 50B to independently adjust a suction force exerted by each suction source at each associated section of the gap G.

Specifically, in the present embodiment, each of the paired suction sources 50A and 50B is formed of a relatively short duct 51 extending generally parallel to and in fluid communication with the gap G between the cooling elements 42U and 42D, and a fan 52 connected to the duct 51 to exhaust air from the gap G through the duct 51 to generate a negative pressure within the gap G. The controller 60 is connected to the motor drive of the fans 52 of the respective suction sources 50A and 50B through wiring or other suitable connectors, not visible in the drawing.

During operation, the suction mechanism SM is activated where necessary, for example, as the belt 30 starts rotation to process a recording sheet S forwarded form the fixing unit 300F. Upon activation, each of the fans 52A and 52B on the opposite sides of the belt assembly draws air from the gap G through the duct 51, which eventually lowers the pressure within the gap G, resulting in a suction force that sucks up the belt 30 toward the gap G in the contact surface 42*a* of the belt cooler 42. The controller 60 controls operation of the individual fans 52A and 52B to adjust the suction forces on the opposite sides of the belt assembly.

Compared to a single suction source, providing the paired suction sources 50A and 50B on the opposite sides of the belt assembly allows for balanced suction forces exerted across the width of the belt 30, which more effectively maintains the belt 30 in close contact with the contact surface 42*a* of the belt cooler 42, leading to more stabilized, smoother movement of the belt 30 in the conveyance direction Y.

Figure 5:
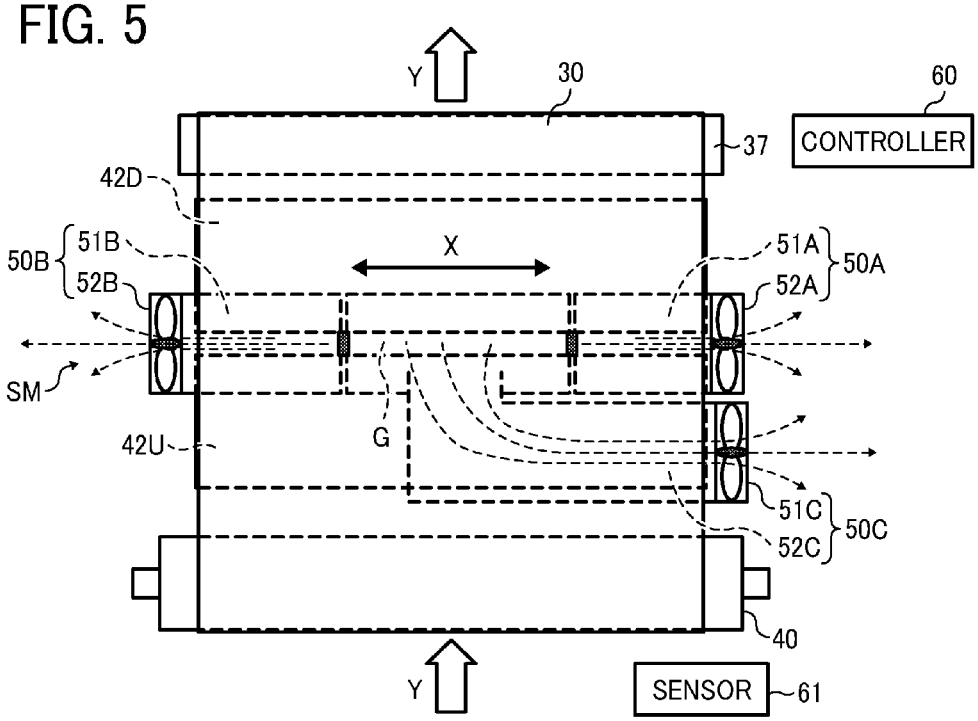
FIG. 5 is a top plan view of the glossing unit including the suction mechanism according to a third embodiment of this patent specification.

FIG. 5 is a top plan view of the glossing unit 300G including the suction mechanism SM according to a third embodiment of this patent specification.

As shown in FIG. 5, the overall configuration of the present embodiment is similar to that depicted primarily with reference to FIG. 4, except that the suction mechanism SM further includes a displacement sensor 61 disposed adjacent to the belt 30 to detect an amount of displacement by which the belt displaces from a proper operational position thereof in the transverse direction X of the belt 30, as well as a third suction source 50C directed to a central section between the two opposite side sections of the gap G.

Specifically, in the present embodiment, the displacement sensor 61 comprises any suitable device that can measure the position and/or change in position of the glossing belt 30, which may be deployed, for example, at one longitudinal end of the belt assembly to detect displacement of the edge of the belt 30. The third suction source 50C is formed of a relatively short duct 51 extending generally parallel to and in fluid communication with the gap G between the cooling elements 42U and 42D, and a fan 52 connected to the duct 51 to exhaust air from the gap G through the duct 51 to generate a negative pressure within the gap G. The controller 60 is operatively connected with the displacement sensor 61, as well as to the motor drive of the fans 52 of the suction source 50C through wiring or other suitable connectors, not visible in the drawing.

During operation, the suction mechanism SM is activated where necessary, for example, as the belt 30 starts rotation to process a recording sheet S forwarded form the fixing unit 300F. Upon activation, each of the fans 52A through 52C on the different positions along the belt assembly draws air from the gap G through the duct 51, which eventually lowers the pressure within the gap G, resulting in a suction force that sucks up the belt 30 toward the gap G in the contact surface 42*a* of the belt cooler 42. The controller 60 controls operation of the individual fans 52A through 52C to adjust the suction forces on the opposite sides of the belt assembly according to the amount of displacement detected by the displacement sensor 61.

More specifically, the controller 60 increases the suction force of the suction source 50 on a side to which the belt 30 displaces from the proper operational position. For example, where the belt 30 slips toward the side on which the first suction source 50A is provided, the controller 60 increases the suction force of the first suction source 50A, so as to temporarily increase the load required to move the belt 30 in the conveyance direction Y on this side of the belt assembly, which eventually causes the belt 30 to move to the original operational position.

The controller 60 may maintain the suction force of the third suction source 50C substantially constant at a sufficient level so as to allow for continuous contact between the belt 30 and the contact surface 42*a* of the belt cooler 42, even where there is a discrepancy between the suction forces exerted on the opposite sides of the belt assembly.

As is the case with the foregoing embodiment, compared to a single suction source, providing the paired suction sources 50A and 50B on the opposite sides of the belt assembly allows for balanced suction forces exerted across the width of the belt 30, which more effectively maintains the belt 30 in close contact with the contact surface 42*a* of the belt cooler 42, leading to more stabilized, smoother movement of the belt 30 in the conveyance direction Y. Further, provision of the displacement sensor 61 allows for effective adjustment of the suction forces of the multiple suction sources by the controller 60.

Figure 6:
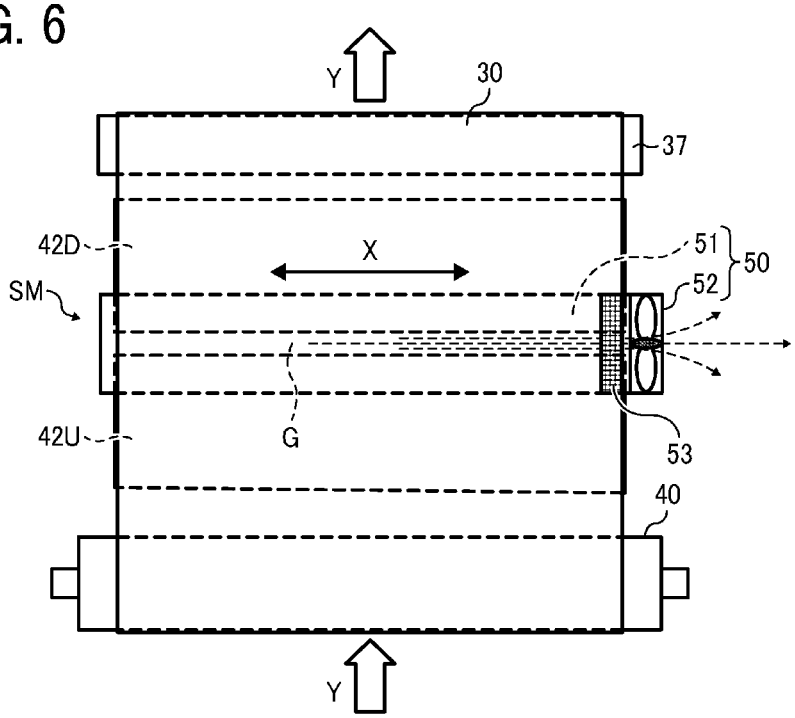
FIG. 6 is a top plan view of the glossing unit including the suction mechanism according to a fourth embodiment of this patent specification.

FIG. 6 is a top plan view of the glossing unit 300G including the suction mechanism SM according to a fourth embodiment of this patent specification.

As shown in FIG. 6, the overall configuration of the present embodiment is similar to that depicted primarily with reference to FIG. 3, except that the suction source further includes a filter 53 between the duct 51 and the fan 52 to remove dust from air flow from the gap G through the duct 51.

Provision of the filter 53 allows the suction mechanism SM to remove dust particles, such as those arising where the belt 30 abrades against the belt cooler 42, from the inner surface of the belt 30, leading to more stabilized movement of the belt 30 while preventing image defects, such as variations in gloss, due to dust accumulated on the belt surface.

Hence, the fixing device 300 according to this patent specification can process a toner image using an endless rotary belt 30 with high-gloss, high-quality imaging performance, wherein the suction mechanism SM connected to the belt cooler 42 creates suction within the gap G between the mutually spaced cooling elements 42U and 42D of the belt cooler 42 to tighten the belt 30 from its inner, back side during rotation downstream from the glossing nip Ng, which prevents the belt 30 from sagging or creasing, while retaining the belt 30 in close, continuous contact with the contact surface 42*a* of the belt cooler 42. Keeping the belt 30 in proper tension leads to uniform and efficient heat transfer from the belt 30 to the belt cooler 42 for concomitant equalization of temperature along the belt 30, which eventually allows for a high, uniform gloss across a resulting image processed through the glossing unit 300G. The image forming apparatus 100 incorporating the fixing device 300 according to one or more embodiments of this patent specification benefits from those and other effects of the fixing device 300.

As used herein, the term "fixing device" according to this patent specification encompasses any device including a pair of opposed rotary members to process a toner image on a recording medium with heat and pressure, the scope of which is not limited to those designed to simply fix a toner image, but include those designed to gloss an unfixed or pre-fixed toner image with heat and pressure. Also, the term "glossing device" herein encompasses any device including a pair of opposed rotary members to process a toner image on a recording medium with heat and pressure, the scope of which is not limited to those designed to gloss an unfixed or pre-fixed toner image with heat and pressure, but also include those designed to simply fix a toner image.

Although in several embodiments described herein, the glossing unit 300G is shown positioned immediately downstream from the fixing unit 300F along the sheet conveyance path, the fixing device 300 according to this patent specification may be configured otherwise than as specifically disclosed herein. For example, the glossing unit 300G may be provided at a separate position from the fixing unit 300F, such as exterior to the image forming apparatus 100. Moreover, the fixing device 300 may be configured without the fixing unit 300F, that is, the glossing unit 300G may serve to fix a toner image by applying heat and pressure to a recording medium S, insofar as the glossing unit 300G functions in a manner substantially identical to that of the fixing unit 300F.

Numerous additional modifications and variations are possible in light of the above teachings. It is therefore to be understood that, within the scope of the appended claims, the disclosure of this patent specification may be practiced otherwise than as specifically described herein.

What is claimed is:

1. A glossing device for processing a toner image on a recording medium, the device comprising:

a first roller;

a second roller parallel to the first roller;

an endless rotary belt looped for rotation around the first and second rollers in a longitudinal, conveyance direction of the belt;

a third roller opposite the first roller via the belt;

a heater adjacent to the belt to heat the belt;

the first and third rollers pressing against each other via the belt to form a nip therebetween through which the recording medium is conveyed to process a toner image under heat and pressure, the recording medium after passage through the nip remaining in contact with the belt as the belt moves from the first roller toward the second roller, and separating from the belt as the belt passes around the second roller;

a belt cooler inside the loop of the belt downstream from the first roller and upstream from the second roller for cooling the belt, the belt cooler including at least two cooling elements disposed inside the loop of the belt and aligned in the conveyance direction of the belt with a gap between the cooling elements; and a suction mechanism connected to the belt cooler to create suction within the gap to attract the belt to the belt cooler.

2. The glossing device according to claim 1, wherein the suction mechanism includes one or more suction sources each directed to a particular section of the gap between the cooling elements.

3. The glossing device according to claim 2, wherein the suction mechanism further includes a controller operatively connected with the suction sources to independently adjust a suction force exerted by each suction source at each associated section of the gap.

4. The glossing device according to claim 2, wherein the suction source includes:

a duct extending generally parallel to and in fluid communication with the gap between the cooling elements; and a fan connected to the duct to exhaust air from the gap through the duct to generate a negative pressure within the gap.

5. The glossing device according to claim 4, wherein the suction source further includes a filter between the duct and the fan to remove dust from air flow from the gap through the duct.

6. The glossing device according to claim 1, wherein the gap between the cooling elements extends at least in a transverse direction perpendicular to the conveyance direction of the belt.

7. The glossing device according to claim 1, wherein the suction mechanism includes:

at least a pair of first and second suction sources directed to two opposite side sections of the gap opposite to each other in the transverse direction of the belt; and a controller operatively connected with the suction sources to independently adjust a suction force exerted by each suction source at each associated section of the gap.

8. The glossing device according to claim 7, wherein the suction mechanism further includes a displacement sensor adjacent to the belt to detect an amount of displacement by which the belt displaces from a proper operational position thereof in the transverse direction of the belt, the controller operatively connected with the displacement sensor to adjust the suction forces of the suction sources according to the amount of displacement detected by the displacement sensor.

9. The glossing device according to claim 8, wherein the controller increases the suction force of the suction source on a side to which the belt displaces from the proper operational position.

10. The glossing device according to claim 7, wherein the suction mechanism further includes a third suction source directed to a central section between the two opposite side sections of the gap, the controller operatively connected with the third suction source to maintain the suction force of the third suction source substantially constant.

11. The glossing device according to claim 1, wherein each of the cooling elements comprises a cooling jacket formed of aluminum, copper, or stainless steel.

12. The glossing device according to claim 1, wherein the gap between the cooling elements has a width of approximately 5 millimeters to approximately 20 millimeters in the conveyance direction of the belt.

13. The glossing device according to claim 1, wherein the contact surface of the belt cooler comprises a convex surface that intrudes into a common tangent plane between the first and second rollers.

14. A fixing device comprising:

a fixing unit to fix a toner image on a recording medium; and a glossing unit disposed downstream from the fixing unit to impart gloss to the fixed toner image, the glossing unit comprising:

a first roller;

a second roller parallel to the first roller;

an endless rotary belt looped for rotation around the first and second rollers in a longitudinal, conveyance direction of the belt;

a third roller opposite the first roller via the belt;

a heater adjacent to the belt to heat the belt;

the first and third rollers pressing against each other via the belt to form a nip therebetween through which the recording medium is conveyed to process a toner image under heat and pressure, the recording medium after passage through the nip remaining in contact with the belt as the belt moves from the first roller toward the second roller, and separating from the belt as the belt passes around the second roller;

a belt cooler inside the loop of the belt downstream from the first roller and upstream from the second roller for cooling the belt, the belt cooler including at least two cooling elements disposed inside the loop of the belt and aligned in the conveyance direction of the belt with a gap between the cooling elements; and a suction mechanism connected to the belt cooler to create suction within the gap to attract the belt to the belt cooler.

15. An image forming apparatus comprising:

an imaging unit to form a toner image on a recording medium; and a fixing device to process the toner image with heat and pressure on the recording medium, the device comprising:

a first roller;

a second roller parallel to the first roller;

an endless rotary belt looped for rotation around the first and second rollers in a longitudinal, conveyance direction of the belt;

a third roller opposite the first roller via the belt;

a heater adjacent to the belt to heat the belt;

the first and third rollers pressing against each other via the belt to form a nip therebetween through which the recording medium is conveyed to process a toner image under heat and pressure, the recording medium after passage through the nip remaining in contact with the belt as the belt moves from the first roller toward the second roller, and separating from the belt as the belt passes around the second roller;

a belt cooler inside the loop of the belt downstream from the first roller and upstream from the second roller for cooling the belt, the belt cooler including at least two cooling elements disposed inside the loop of the belt and aligned in the conveyance direction of the belt with a gap between the cooling elements; and a suction mechanism connected to the belt cooler to create suction within the gap to attract the belt to the belt cooler.

* * * * *